United States Patent [19]

Inoue

[11] Patent Number: 4,460,239

[45] Date of Patent: Jul. 17, 1984

[54] CONNECTOR TERMINAL

[75] Inventor: Nori Inoue, Suzuka, Japan

[73] Assignee: Tokai Electric Wire Company Limited, Yokkaichi, Japan

[21] Appl. No.: 378,722

[22] Filed: May 17, 1982

[30] Foreign Application Priority Data

Mar. 11, 1981 [JP] Japan ..... 56-33827

[51] Int. Cl.[3] ..... H01R 11/22

[52] U.S. Cl. ..... 339/258 F

[58] Field of Search ..... 339/258 R, 258 P, 258 F, 339/97 R, 258 S, 256 R, 256 S

[56] References Cited

U.S. PATENT DOCUMENTS 4,036,545 7/1977 Mysiak ..... 339/97 R X
4,130,331 12/1978 Neff et al. ..... 339/97 R
4,212,509 7/1980 Brooks et al. ..... 339/97 R X

FOREIGN PATENT DOCUMENTS 56-4185 1/1981 Japan ..... 339/258 S
56-4186 1/1981 Japan ..... 339/258 S

*Primary Examiner*—William R. Briggs
*Attorney, Agent, or Firm*—Cushman, Darby & Cushman

[57] ABSTRACT

A connector terminal for providing electric connection between the tab-like contactor of a fuse or a relay and a conductive path in a fuse box, relay box or the like having a multiplicity of conductor strips. The connector terminal has a base plate, opposing side walls standing upright from both sides of the base plate, slots formed in respective side walls to extend downwardly over a predetermined length from the upper ends of the side walls so as to divide respective side walls into first portions remote from the base plate and second portions adjacent to the base plate, respectively. A resilient contact piece extends from the upper end of the second portion of at least one of the side walls. The resilient contact piece extends from the upper end of the second portion of one of the side walls through an upward convexity and then downwardly into the space between the second portions of opposing side walls so as to constitute a receptacle for receiving a male tab of a fuse, relay or the like converge downwardly into said space.

4 Claims, 16 Drawing Figures

CONNECTOR TERMINAL

FIELD OF THE INVENTION

The present invention relates to a connector terminal for use in electric wiring in automobiles or the like and, more particularly, to a connector terminal for connecting tab-like contact portion of a fuse or a relay to a conductive path thereby to electrically connect the fuse or the relay between wiring conductor paths in a junction block such as a fuse box, relay box or a fuse/relay box in electric wiring in automobiles or the like.

DESCRIPTION OF THE PRIOR ART

Figure 1:
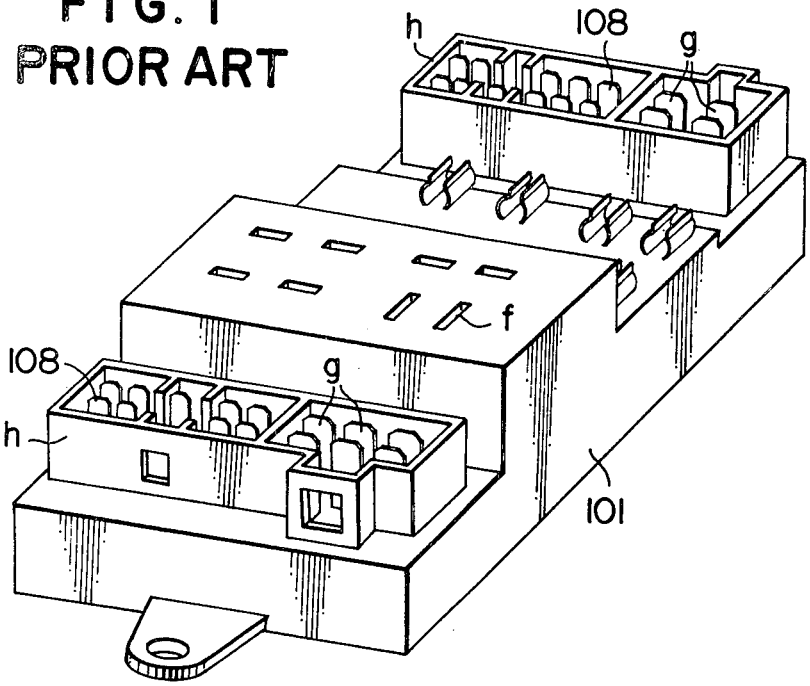
FIG. 1 PRIOR ART
FIG. 1 is a perspective view of the whole structure of a conventional junction block.
Figure 2:
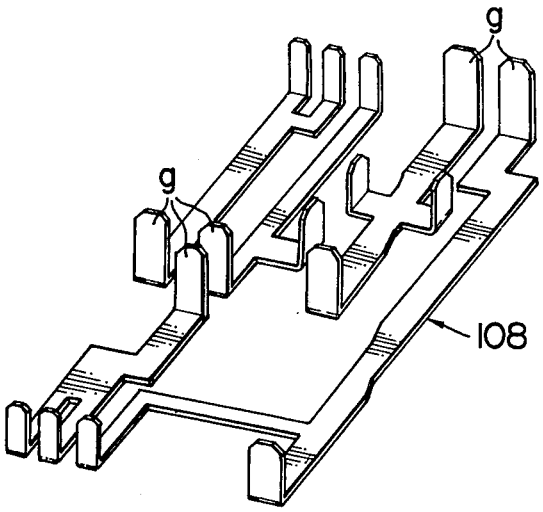
FIG. 2 PRIOR ART
FIG. 2 is a perspective view of a conductive member incorporated in the junction block.

Hitherto, a connection device referred to as "junction block" is widely used for a concentric connection of electric wirings extending from various electric parts mounted on automobile. As shown in FIG. 1, the junction block has an insulation box 101 accomodating a multiplicity of conductive members 108. Each conductive member 108 is generally referred to as BUS BAR and is produced by punching from a metal sheet in a complicated shape as shown in FIG. 2 and bending the ends to form contact terminals (g). These conductive members 108 are superposed in layers through the medium of insulators and accomodated in the insulation box 101. The contact terminals (g) of the conductive member 108 are exposed to the outside through sockets (h) of the insulation box 101. The insulation box 101 is provided with slits (f) for receiving a male type contactor or a tab-like contactor 110 (See FIG. 4) of a relay, fuse or the like.

Figure 4:
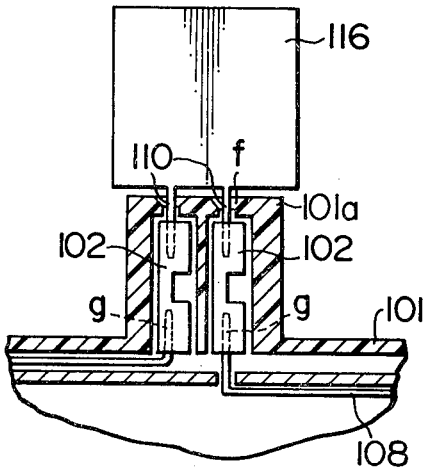
FIG. 4 PRIOR ART
FIG. 4 is a partial sectional view of the connector terminal shown in FIG. 3 in the state of use.
Figure 3:
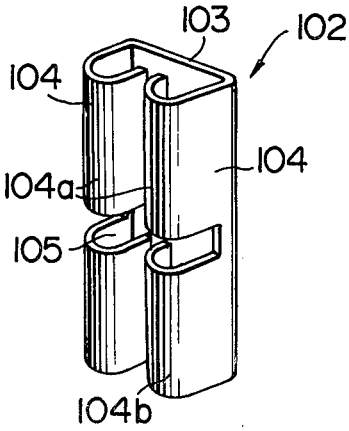
FIG. 3 PRIOR ART
FIG. 3 is a perspective view of a conventional connector terminal incorporated in the conventional junction block.

FIG. 3 shows a connector terminal 102 for use in the conventional junction block described above. This connector terminal 102 has a base plate 103 and side walls 104 which are curved and divided in the vertical direction into two parts by central notches 105. As shown in FIG. 4, the connector terminal 102 is accomodated by a connector terminal receptacle 101*a* in the junction block 101 as shown in FIG. 4. The space defined by the base plate 103 and the lower portions 104*b* of both side walls 104 receives the contact terminal (g) of the conductive member 108, while a space defined between the upper portions 104*a* of the side walls 104 and the base plate 103 receives the tab-like contactor 110 of a relay of a fuse 116.

The present inventor has made an intense study on the above-described junction block to improve the same. The junction block of the type described has a drawback that a troublesome work is required for stacking in layers a multiplicity of conductive members 108 punched out in various forms and for setting the layers of conductive members 108 in the insulation box.

Under this circumstance, the present inventor has succeeded in developing a junction block which can easily be assembled by inserting in order a multiplicity of conductor strips into right places in the insulation box. This type of junction block is desclosed in the specification of co-pending U.S. Application Ser. No. 321,228 filed on Nov. 13, 1981.

The development of the junction block incorporating conductor strips by the present inventor has given a rise to the demand for connector terminals suited for use in combination with such a junction block. Namely, the conventional connector terminal shown in FIG. 3 is designed and constructed to receive male terminals, i.e. contact terminal (g) and tab-like contactor 110 which have comparatively small widths, and cannot be used in combination with the junction block incorporating conductor strips.

SUMMARY OF THE INVENTION

Accordingly, an object of the invention is to provide a connector terminal suited for use in combination with a junction block incorporating conductor strips and capable of easily forming a fuse circuit or a relay circuit.

To this end, according to the invention, there is provided a connector terminal comprising: a base plate; a pair of opposing side walls extending from both side edges of the base plate substantially at a right angle to the plane of the base plate; a slot formed in one of the side walls so as to extend over a predetermined length from the upper end of the side wall downwardly to divide the side wall into a first portion remote from the base plate and a second portion adjacent to the base plate; another slot formed in the other side wall and extending over a predetermined length from the upper end of said other side wall downwardly, the another slot being substantially in alignment with the first-mentioned slot and dividing the other side wall into a first portion remote from the base plate and a second portion adjacent to the base plate; a resilient contact piece extending from the upper end of the second portion of at least one of the side walls into the space between the second portions of both side walls, the resilient contact piece constituting a receptacle for receiving a male tab, the receptacle extending from the upper end of the second portion of at least one of the side walls and curved to convex upwardly and then extending downwardly through the above-mentioned space downwardly and gradually away from the base plate to progressively converge downwardly into the above-mentioned space.

The above and other objects, features and advantages of the invention will become clear from the following description of the preferred embodiment taken in conjunction with the accompanying drawings.

DESCRIPTION OF THE PREFERRED EMBODIMENTS

Referring to FIGS. 5 to 9, a relay terminal 1 in accordance with a first embodiment of the invention has a base plate 2, and a pair of opposing side walls 4,4' extending from both sides of the base plate 2 substantially at a right angle to the plane of the base plate 2.

A slot 5 is formed in the portion of the side wall 4 adjacent to the free end (left end as viewed FIG. 5) so as to extend downwardly over a predetermined length from the upper end of the side wall 4. The slot 5 divides the side wall 4 into a first portion 4*a* adjacent to the free end thereof and a second portion 4*b* adjacent to the base plate 2. Similarly, a slot 5' is formed in the portion of the other side wall 4' adjacent to the free end (left end as viewed in FIG. 5) thereof so as to extend downwardly over a predetermined length from the upper end of the side wall 4', substantially in alignment with the first-mentioned slot 5. The slot 5' divides the side wall 4' into a first portion 4*a'* adjacent to the free end thereof and a second portion 4*b'* adjacent to the base plate 2. A contact piece or a resilient tongue 7 extend from the upper end of the second portion 4*b* of the side wall 4. This resilient tongue has a curved portion curved to convex upwardly and a downwardly extending portion connected to the curved portion and extending downwardly through the space between the second portionds 4*b*,4*b'* of both side walls 4,4'.

Figure 5:
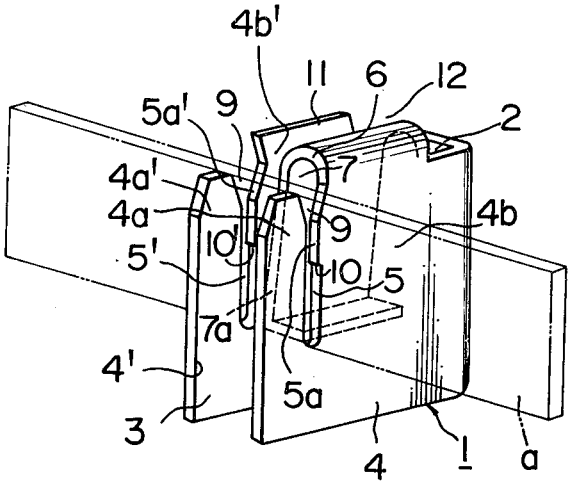
FIG. 5 is a perspective view of a connector terminal in accordance with a first embodiment of the invention with a conductor strip attached thereto.
Figure 6:
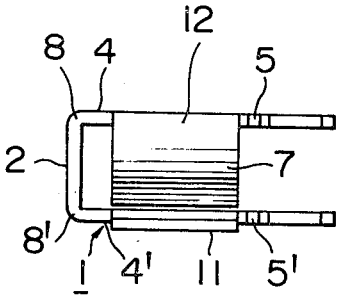
FIG. 6 is a top plan view of a connector terminal in accordance with the first embodiment of the invention.
Figure 7:
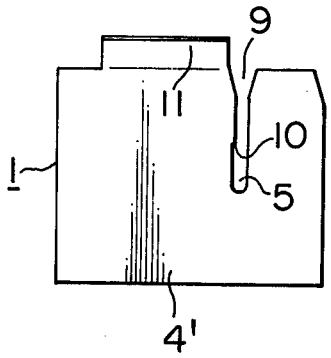
FIG. 7 is a front elevational view of a connector terminal as shown in FIG. 6.

The side walls 4,4' are connected to both sides of the base plate 2 through bent portions 8,8'. The slots 5,5' formed in the side walls 4,4' have open in the upper ends of the side walls 4,4' in upwardly diverging manner as at 9,9' as shown in FIG. 5. Steps 10,10' are formed on the inner surfaces 5*a*,5*a'* of the slots 5,5' adjacent to the base plate 2. The steps 10,10' are formed on lengthwise or depthwise mid portion of the slots 5,5'. The width of the slots 5,5' is greater at the portion thereof below the steps 10,10' than at the portions above the steps 10,10'.

The contact piece or the resilient tongue 7 extends from the upper end of the second portion 4*b* of the side wall 4 between the slot 5 and the bent portion 8 such that its free end approaches the other side wall 4' opposing to the associated side wall 4. The outermost end of the contact piece or resilient tongue 7 is bent towards the side wall 4. An outwardly bent guide portion 11 is formed on the upper end of the second portion 4*b'* of the other side wall 4' to extend away from the side wall 4. The top of the guide portion 11 and the top of the curved portion is flush with each other. The side edge 7*a* of the resilient tab 7 adjacent to the slots 5,5' is located such that it does not project into the slots 5,5' so as not to hinder the insertion of the conductor strip (a) into the slots 5,5'.

Figure 9:
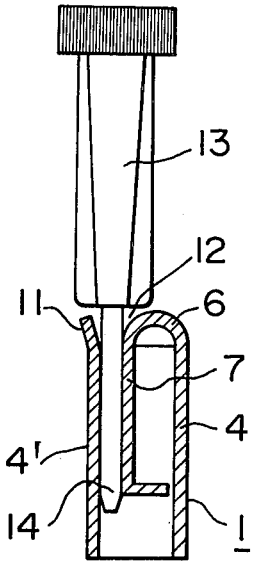
FIG. 9 is a partly sectioned side elevational view of a connector terminal of the first embodiment with a blade type fuse mounted thereon.
Figure 8:
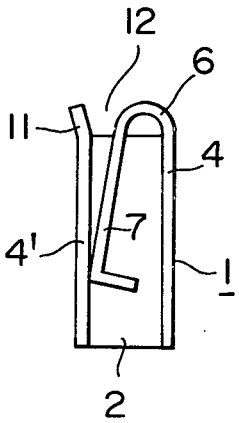
FIG. 8 is a right side elevational view of the connector terminal shown in FIG. 6.

The connector terminal 1 having the described construction is adapted to mount the conductor strip (a) such that the latter is held in the slots 5,5' to extend horizontally between the side walls 4,4' in such a manner that the conductor strip (a) opposes to the flat portion of the base plate 2. As shown in FIG. 9, the male tab 14 of a blade type fuse 13 is received by the receptacle 12 surrounded by the base plate 2, side walls 4,4' and the conductor strip (a).

Therefore, the male tab 14 fitting in the receptacle 12 is clamped between the resilient tongue 7 and the side wall 4' while being guided by the curved portion 6 and the guide portion 11.

In inserting the male tab 14 into the receptacle portion 12, it is often experienced that a load in excess of the limit of resiliency is applied to the resilient tongue 7 due to an unreasonable driving of the male tab 14. However, since the end of the resilient tongue 7 (lower end as viewed in FIG. 9) is bent to the rightside, the end of the resilient tongue 7 abuts an inner surface of the side wall 4 to resist to such an excessively heavy load.

Figure 10:
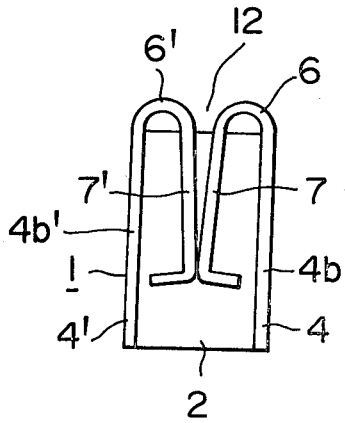
FIG. 10 is a side elevational view of a connector terminal in accordance with a second embodiment of the invention.
Figure 11:
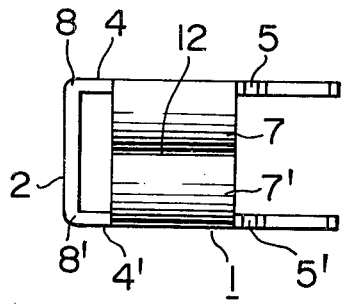
FIG. 11 is a top plan view of the connector terminal shown in FIG. 10.
Figure 12:
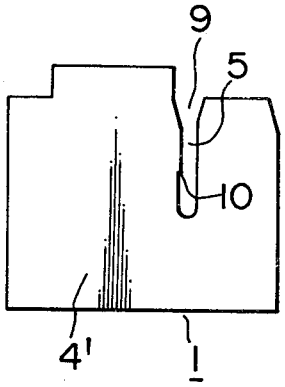
FIG. 12 is a front elevational view of the connector terminal shown in FIG. 11.
Figure 13:
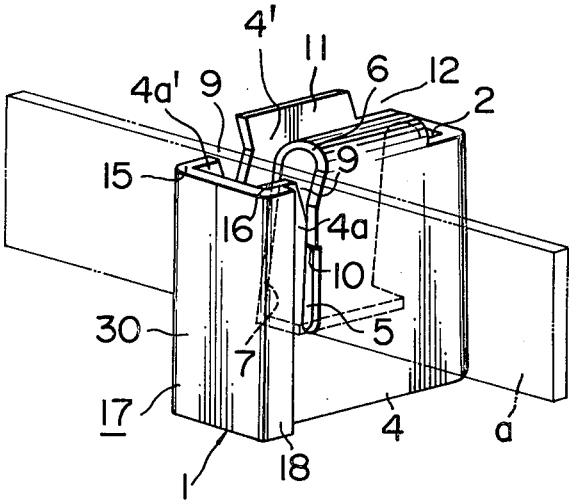
FIG. 13 is a perspective view of a connector terminal in accordance with a third embodiment of the invention in the state in which it is mounted on a conductor strip.

FIGS. 10, 11 and 13 show a connector terminal 1 in accordance with a second embodiment of the invention. As in the case of the first embodiment, the connector terminal 1 of the second embodiment has a contact piece or resilient tongue 7 extending from the upper end of the second portion (4*b*) of one 4 of the side walls. In the relay station of the second embodiment, however, another contact piece or resilient tongue 7' is formed to extend from the upper end of the second portion 4*b'* of the other side wall in symmetry to the resilient tongue 7. The resilient tongue 7' is extended downwardly (as viewed in FIG. 10) through a curved portion 6' which is similar to the curved portion 6 of the resilient tongue 7 so as to face and gradually approach the opposing resilient tongue 7. The lower end of the resilient tongue 7' is bent toward the side wall 4'. Therefore, a receptacle 12 for receiving the male tab 14 of the blade type fuse 3 (See FIG. 9), gradually converging downwardly is formed between the resilient tongues 7,7'. The male tab 14 received by the receptacle 12 is resiliently clamped by the resilient tongues 7,7'. Other portions of the second embodiment are materially identical to those of the first embodiment. In FIGS. 10 thru 12, the same reference numerals are used to denote the same parts or members as those in FIGS. 5 thru 9.

FIG. 13 shows a connector terminal 1 in accordance with a third embodiment of the invention. The connector terminal 1 of the third embodiment has a reinforcement member 17 provided with a flat plate portion 30 which extends from the outer end (left end as viewed in FIG. 13) of the first portion 4*a'* of one 4' of the side walls and extending through the bent portion 15 so as to oppose to the base plate 2. The reinforcement member 17 is provided also with a hook portion 18 which projects from the right end of the flat plate portion 30 through a bent portion 16 and extends substantially in parallel with the outer surface of the other side wall 4 over a small distance. The hook portion 18 fits in a portion of the outer surface of the first portion 4*a* of the side wall 4 adjacent to the outer edge (left side edge as viewed in FIG. 13) of the first portion 4*a*.

Other portions of the third embodiment are materially identical to those of the first embodiment. The same reference numerals are used to denote the same parts or members as those in FIGS. 5 thru 9.

According to the third embodiment, the connector terminal 1 as a whole is made stiff and rigid thanks to the presence of the reinforcement member 17.

An explanation will be made hereinunder as to how the connector terminal having the described embodiment is used.

Figure 14:
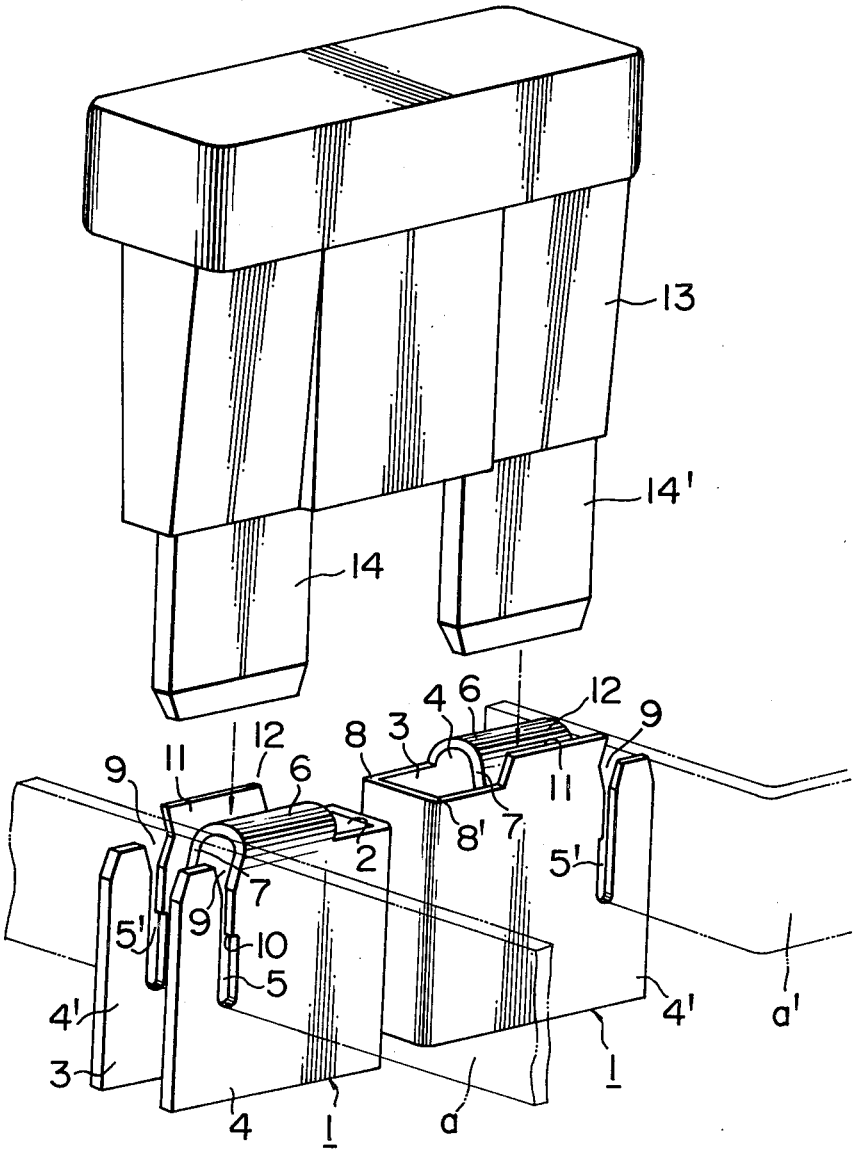
FIG. 14 is a perspective view of a connector terminals in accordance with the invention in the state of use.

FIG. 14 shows one of the forms of usage of the connector terminal. Two conductor strips (a),(a') are accomodated by an insulation box (not shown) in such a manner that the flat surfaces of these conductor strips oppose to each other over the entire length or a part of the length thereof. FIG. 14 shows an arrangement for forming a fuse circuit between two conductive pieces (a),(a') by means of a blade type fuse 13 connected therebetween. Actually, the insulation box accomodates a number of conductor strips although two (a),(a') of them are shown in FIG. 14. The insulation box accomodating a multiplicity of conductor strips, i.e. the junction block, is disclosed in the aforementioned copending U.S. application Ser. No. 321,228.

For forming a fuse circuit between the conductor strips (a),(a') as shown in FIG. 14, slots 5,5' of each of the pair of connector terminals 1 are fitted to the conductor strips (a),(a'), and the male tabs 14,14' of the blade type fuse 13 are inserted into the receptacle 12 of the connector terminal shown at left side of FIG. 14 and the conductor strip (a) and into the receptacle 12 of the connector terminal shown at the right side in FIG. 14, respectively, thereby to connect the blade type fuse 13 between the two conductor strips (a),(a').

Figure 15:
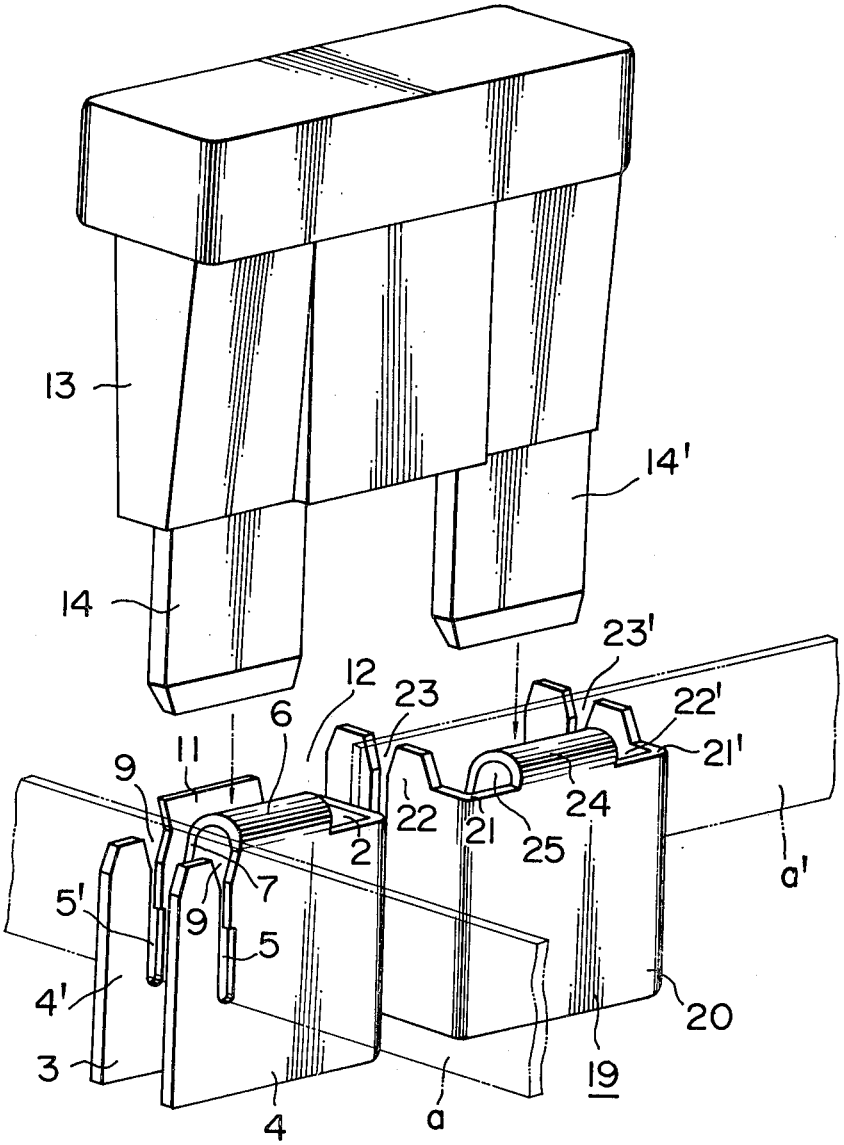
FIG. 15 is a perspective view of connector terminals in accordance with the invention in another state of use.
Figure 16:
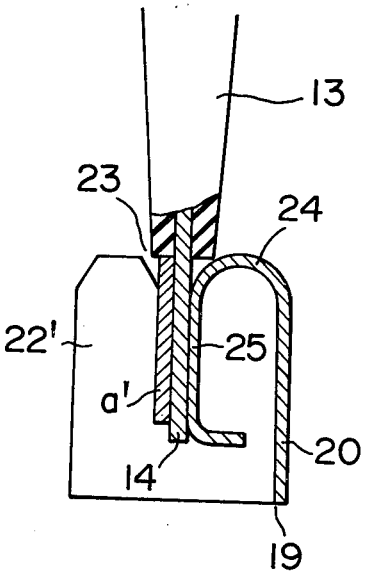
FIG. 16 is a partly-sectioned side elevational view of a connector terminal used in combination with the connector terminal of the invention in the arrangement shown in FIG. 15.

FIG. 15 illustrates a method of forming a fuse circuit by connecting a blade type fuse 13 between the pair of conductor strips (a),(a') in such a case that one (a) of the conductor strips is disposed at a right angle to the other (a'). In this case, the connector terminal of the invention is mounted on one (a) of the conductor strip (a), while a connector terminal 19 having the following construction is mounted on the other conductor strip (a') which crosses the first-mentioned conductor strip at a right angle and with a certain gap therebetween. Then, the male tabs 14,14' of the blade type fuse 13 are inserted into the connector terminals 1 and 19 so that the blade type fuse 13 is connected between the conductor strips (a),(a').

The connector terminal 19 mentioned above has a base plate 20 and a pair of opposing walls 22,22' connected to both sides of the base plate 20 through bent portions 21,21'. The side walls 22,22' are provided with slots 23,23' which open in the uper end thereof and adapted to hold the conductor strip (a') such that the latter extends between the side walls 22,22'. A contact piece 25 extends from the upper end of the base plate 20 through a curved portion 24 such that the free end of the contact piece 25 gradually approaches the conductor strip (a). In use, the male tab 14' of the blade type fuse 13 is clamped between the contact piece 25 and the conductor strip (a').

Although two connector terminals used in the arrangement shown in FIG. 14 and the connector terminal shown at the left side of FIG. 15 are the connector terminals of the first embodiment, it is of course possible to use the connector terminal of the second embodiment or the third embodiment in place of the connector terminal of the first embodiment in the arrangements shown in FIGS. 14 and 15.

As has been described, according to the invention, the connector terminal can be used effectively in connecting a fuse or a relay between a plurality of conductor strips in a fuse box, relay box or a fuse/relay box in which conductor strips constituting the wiring conductive paths are arranged in a box in such a manner that the flat surfaces of the conductor strips oppose to each other.

What is claimed is:

1. A connector terminal for use with a junction block incorporating therein a number of conductor strips, comprising: a base plate; a pair of opposing side walls extending from both side edges of said base plate substantially at a right angle to the plane of said base plate; a slot formed in one of said side walls so as to extend over a predetermined length from the upper end of said side wall downwardly to divide said side wall into a first portion remote from said base plate and a second portion adjacent to said base plate; another slot formed in the other side wall and extending over a predetermined length from the upper end of said other side wall downwardly, said another slot being substantially in alignment with the first-mentioned slot and dividing the other side wall into a first portion remote from said base plate and a second portion adjacent to said base plate, said slots being adapted to receive one of said conductor strips; a resilient contact piece extending from the upper end of said second portion of at least one of said side walls into the space between said second portions of both side walls, said resilient contact piece constituting a receptacle for receiving a male tab, said receptacle extending from the upper end of said second portion of at least one of the side walls and curved to convex upwardly and then extending downwardly into said space gradually away from the upper end of said at least one side wall to progressively converge downwardly into said space toward the other of said side walls.

2. A connector terminal as claimed in claim 1, wherein said resilient contact piece extends from the upper end of the second portion of one of said side walls so as to cooperate with the inner surface of said second portion of the other side wall to define therebetween said receptacle.

3. A connector terminal as claimed in claim 1, characterized by comprising two resilient contact pieces extending from the upper ends of the second portions of respective side walls to cooperate with each other in defining therebetween said receptacle.

4. A connector terminal as claimed in claim 1 or 2, characterized by further comprising a reinforcement member including a flat plate portion which extends from the outer end of said first portion of one of said side wall and extending to oppose to said base plate, and a hook portion bent from one end of said flat plate portion to approach the outer surface of said first portion of the other side wall and fixed to said outer surface.

* * * * *